US010557618B2

(12) United States Patent
Ernst

(10) Patent No.: US 10,557,618 B2
(45) Date of Patent: Feb. 11, 2020

(54) RETENTION SYSTEM FOR LIGHT SOURCE LAMPS IN RECESSED LUMINAIRES

(71) Applicant: Eaton Intelligent Power Limited, Dublin (IE)

(72) Inventor: Oliver Ernst, Peachtree City, GA (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 15/986,484

(22) Filed: May 22, 2018

(65) Prior Publication Data

US 2019/0360668 A1 Nov. 28, 2019

(51) Int. Cl.

| | |
|---|---|
| ***F21S 8/00*** | (2006.01) |
| ***F21V 19/00*** | (2006.01) |
| ***F21K 9/237*** | (2016.01) |
| ***F21V 7/04*** | (2006.01) |
| ***F21K 9/68*** | (2016.01) |
| *F21Y 101/00* | (2016.01) |
| *F21S 8/02* | (2006.01) |
| *F21Y 115/10* | (2016.01) |

(52) U.S. Cl.

CPC ..... *F21V 19/007* (2013.01); *F21K 9/237* (2016.08); *F21K 9/68* (2016.08); *F21V 7/048* (2013.01); *F21V 19/004* (2013.01); *F21S 8/026* (2013.01); *F21Y 2101/00* (2013.01); *F21Y 2115/10* (2016.08)

(58) Field of Classification Search

CPC .... F21S 8/02; F21S 8/022; F21S 8/024; F21S 8/026; F21S 8/028; F21S 8/036

USPC ..... 362/263

See application file for complete search history.

(56) References Cited

U.S. PATENT DOCUMENTS

| | | | | |
|---|---|---|---|---|
| 1,494,054 A * | 5/1924 | Alexander | F21V 11/00 | 362/256 |
| 3,609,346 A * | 9/1971 | Lund | F21S 8/02 | 362/364 |
| 5,758,959 A * | 6/1998 | Sieczkowski | F21S 8/026 | 362/148 |
| 2010/0039829 A1* | 2/2010 | Tsai | F21S 8/026 | 362/373 |
| 2012/0140466 A1* | 6/2012 | Yang | F21V 7/0008 | 362/235 |
| 2017/0045188 A1* | 2/2017 | Im | F21V 29/00 | |

* cited by examiner

*Primary Examiner* — Matthew J. Peerce

(74) *Attorney, Agent, or Firm* — King & Spalding LLP

(57) ABSTRACT

A retention system for holding a light source lamp in a recessed luminaire includes a retention spring portion that is pivotally coupled to a light source holding bracket of the recessed luminaire. The light source holding bracket is configured to house a light source lamp therein. Further, the retention system includes a retention arm portion that extends from and is formed integral with the retention spring portion. The retention spring portion forces the retention arm portion towards the light source holding bracket such that the retention arm portion engages and applies an active load on the light source lamp that is disposed in the light source holding bracket to securely retain the light source lamp within the recessed luminaire.

20 Claims, 12 Drawing Sheets

RETENTION SYSTEM FOR LIGHT SOURCE LAMPS IN RECESSED LUMINAIRES

TECHNICAL FIELD

The present disclosure relates generally to lighting solutions, and more particularly to a retention system for light source lamps in recessed luminaires.

BACKGROUND

Recessed luminaires may include a recessed housing can that is disposed in a ceiling. The recessed housing can may house a light source assembly and a finishing section therein. The light source assembly may include a light source and a light source retention device that is configured to securely retain the light source within the recessed luminaires. The light source may include, but is not limited to, a light source lamp (commonly known as 'light bulb'). One such light source lamp that is traditionally used with recessed luminaires is a multifaceted reflector halogen lamp such as the MR16 halogen lamp. With the advent of light emitting diode (LED) technology that has higher energy efficiency and longevity than halogen lamps, the multifaceted reflector halogen lamps are being replaced with reflector type LED lamps. The size and shape of such reflector type LED lamps, especially MR16 LED lamps with GU10 base (also known as PAR16) or GU5.3 base, are different from that of the multifaceted reflector halogen lamps. Existing light source retention devices that are configured to securely retain the multifaceted reflector halogen lamps within the recessed luminaires may not be configured to receive the reflector type LED lamps in the recessed luminaires. That is, the existing light source retention devices may not be configured to adjust to and accommodate the secure retention of different light source lamps, such as both the multifaceted reflector halogen lamps and reflector type LED lamps. Instead, different light source retention devices may need to be used for the retention of different light source lamps.

For example, as illustrated in FIG. 1, an example existing retention device 102 (e.g., leaf spring) that is fixedly coupled to the a light source holder bracket 104 using a fastener 106 may be configured to securely retain a multifaceted reflector lamps, such as an MR16 halogen lamp 108. However, the existing retention device 102 is not flexible enough (e.g., at least in a vertical direction) to install reflector type LED lamps (e.g., MR16 LED lamps with GU10 base (also known as PAR16) or GU5.3 base) that may be larger and/or wider in size and shape than the MR16 halogen lamp 108. The limited flexibility of the existing retention device 102 may not allow the existing retention device 102 to receive the larger and/or wider reflector type LED lamps. A retention device in shape of the a leaf spring that can accommodate the larger and/or wider reflector type LED lamps can cause the multifaceted reflector halogen lamps to rattle or have undesirable movement within the recessed luminaire 100. Further, the retaining arms 171 of the existing retention device 102 may get caught in the heat sink fins of the reflector type LED lamp which may be undesirable.

This background information is provided to reveal information believed to be of possible relevance to the present disclosure. No admission is necessarily intended, nor should be construed, that any of the preceding information constitutes prior art against the present disclosure.

SUMMARY

In one aspect, the present disclosure is directed to a recessed luminaire that includes a light source holding bracket configured to hold a light source lamp therein. Further, the recessed luminaire includes a retention device that is pivotally coupled to the light source holding bracket. The retention device includes a retention spring portion that is pivotally coupled to the light source holding bracket, and a retention arm portion that extends from and is formed integral with the retention spring portion. The retention spring portion is configured to force the retention arm portion towards the light source holding bracket such that the retention arm portion engages and applies an active load on the light source lamp when disposed in the light source holding bracket to securely retain the light source lamp within the recessed luminaire.

In another aspect, the present disclosure is directed to a retention system that includes a retention spring portion that is pivotally coupled to a light source holding bracket. The light source holding bracket is configured to house a multifaceted reflector lamp therein. Further, the retention system includes a retention arm portion that extends from and is formed integral with the retention spring portion. The retention spring portion is configured to force the retention arm portion towards the light source holding bracket such that the retention arm portion engages and applies an active load on the multifaceted reflector lamp disposed in the light source holding bracket to securely retain the multifaceted reflector lamp.

These and other aspects, objects, features, and embodiments, will be apparent from the following description and the appended claims.

BRIEF DESCRIPTION OF THE FIGURES

The foregoing and other features and aspects of the present disclosure are best understood with reference to the following description of certain example embodiments, when read in conjunction with the accompanying drawings, wherein.

Figure 1:
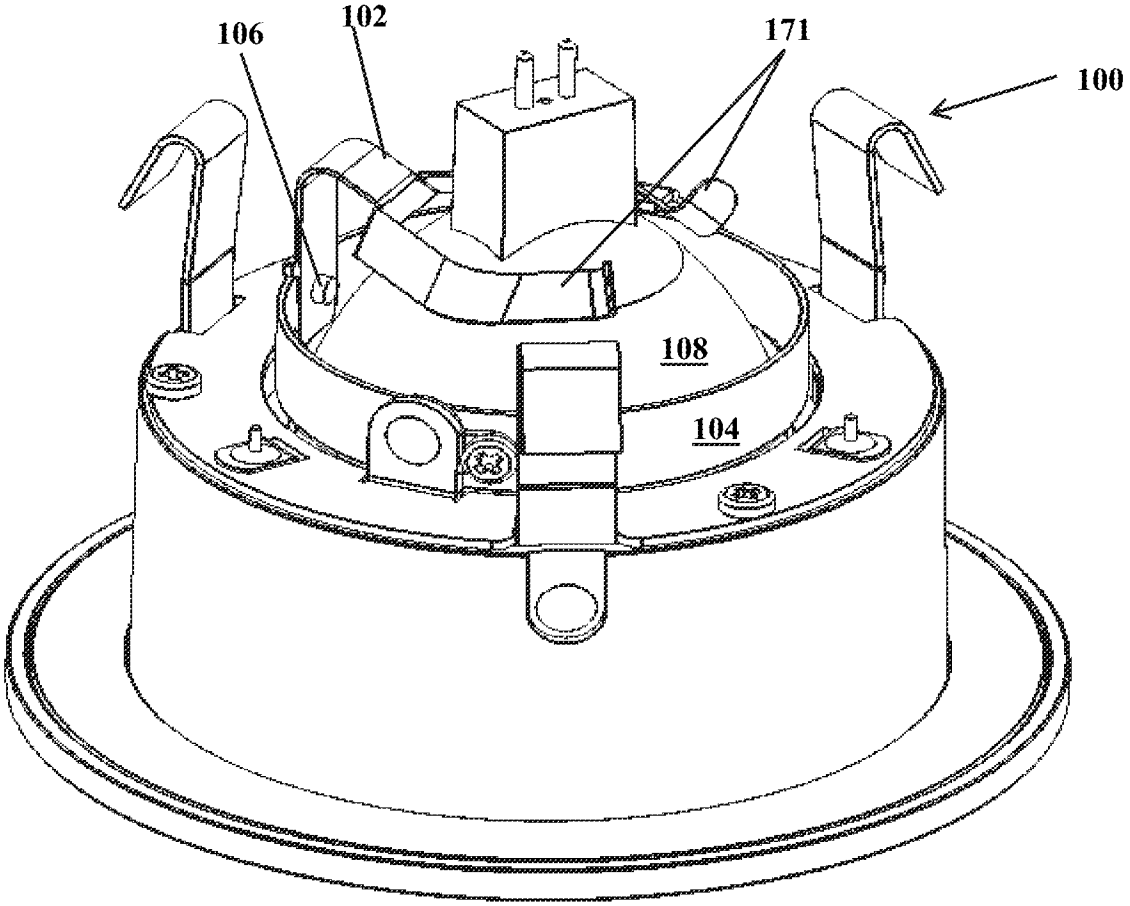
FIG. 1 (Prior Art)
FIG. 1 illustrates a perspective view of a recessed luminaire comprising an existing light source retention device and a multifaceted reflector halogen lamp retained by the existing light source retention device, in accordance with a prior art luminaire.

The drawings illustrate only example embodiments of the present disclosure and are therefore not to be considered limiting in its scope, as the present disclosure may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles.

In the foregoing figures showing example embodiments of the example retention system, one or more of the components shown may be omitted, repeated, and/or substituted. Accordingly, the example embodiments of the recessed luminaire should not be considered limited to the specific arrangements of components shown in any of the figures. For example, features shown in one or more figures or described with respect to one embodiment can be applied to another embodiment associated with a different figure or description.

DETAILED DESCRIPTION OF EXAMPLE EMBODIMENTS

The present disclosure describes a retention system for light source lamps in recessed luminaires. In particular, the retention system may include a mousetrap style retention device that comprises a retention spring and a retention arm that is formed integral with and extending from the retention spring. The retention arm may be shaped substantially like a two-pronged fork and may comprise a first arm, a second arm, and a lamp holder cavity (also referred to as a 'retention opening') formed in between the two arms. The retention device may be pivotally coupled to a light source holding bracket that holds a light source lamp therein. The retention device may be configured to adapt to the body sizes and shapes of different light source lamps and apply an active (positive) load on the light source lamps to securely hold the light source lamps in the recessed luminaire.

In one example, in a default state, the retention arms of the retention device may engage the light source holding bracket. To install the light source lamp within the recessed luminaire, the retention device may be pivoted upwards or pulled backwards by lifting the retention arms up and away from the light source holding bracket such that the retention spring compresses or expands and stores potential energy. The retention arms may be lifted up or pulled backwards until they clear or do not interfere with disposing the light source lamp in the light source holding bracket. Then, the light source lamp may be placed in the light source holding bracket. Responsive to placing the light source lamp in the light source holding bracket, the retention arms of the retention device may be released and the retention spring either expands or compresses to convert the potential energy into kinetic energy, thereby reverting the retention arms back to their default position. As the retention arms revert back to their default position, the retention arms may engage the light source lamp such that: (a) a portion of the light source lamp is disposed in the retention opening defined by the retention arms of the retention device, (b) the light source lamp is centered within the light source holding bracket, and (c) an active load is applied on the light source lamp by the retention arms to securely retain the light source lamp in the light source holding bracket without any undesirable movement (e.g., rattling).

Turning now to the figures, example embodiments of the retention system will be described in connection with FIGS. 2-10. Referring to FIGS. 2-6, an example recessed luminaire 200 may include a trim assembly 202 that comprises a trim ring 204 and a reflector 206 that is coupled to the trim ring 204. The reflector 206 may be disposed in an opening 207 defined by the trim ring 204 such that the trim ring 204 rests on a flange 205 of the reflector 206. In one example embodiment, the reflector 206 may be a conical reflector, however, in other example embodiments, the reflector 206 may be any other appropriate reflector without departing from a broader scope of the disclosure. Further, the recessed luminaire 200 may include a first light source holding bracket 208 that is coupled to the trim assembly 202 via a rotation bracket assembly 210 that allows a first light source lamp 218 that is housed in the first light source holding bracket 208 to be rotated as desired by an end user. The rotation bracket assembly 210 may include a base bracket 214 that is coupled to the trim ring 204 and a rotation bracket 216 that is disposed on and securely coupled to the base bracket 214 using the securing tabs 217 of the base bracket 214. The lamp source holding bracket 208 may be pivotally coupled to the rotation bracket 216. Accordingly, in the example embodiment of FIG. 2, the lamp source holding bracket 208 may be a tilt ring that allow a first light source lamp 218 disposed therein to be tilted as desired by an end user.

Figure 2:
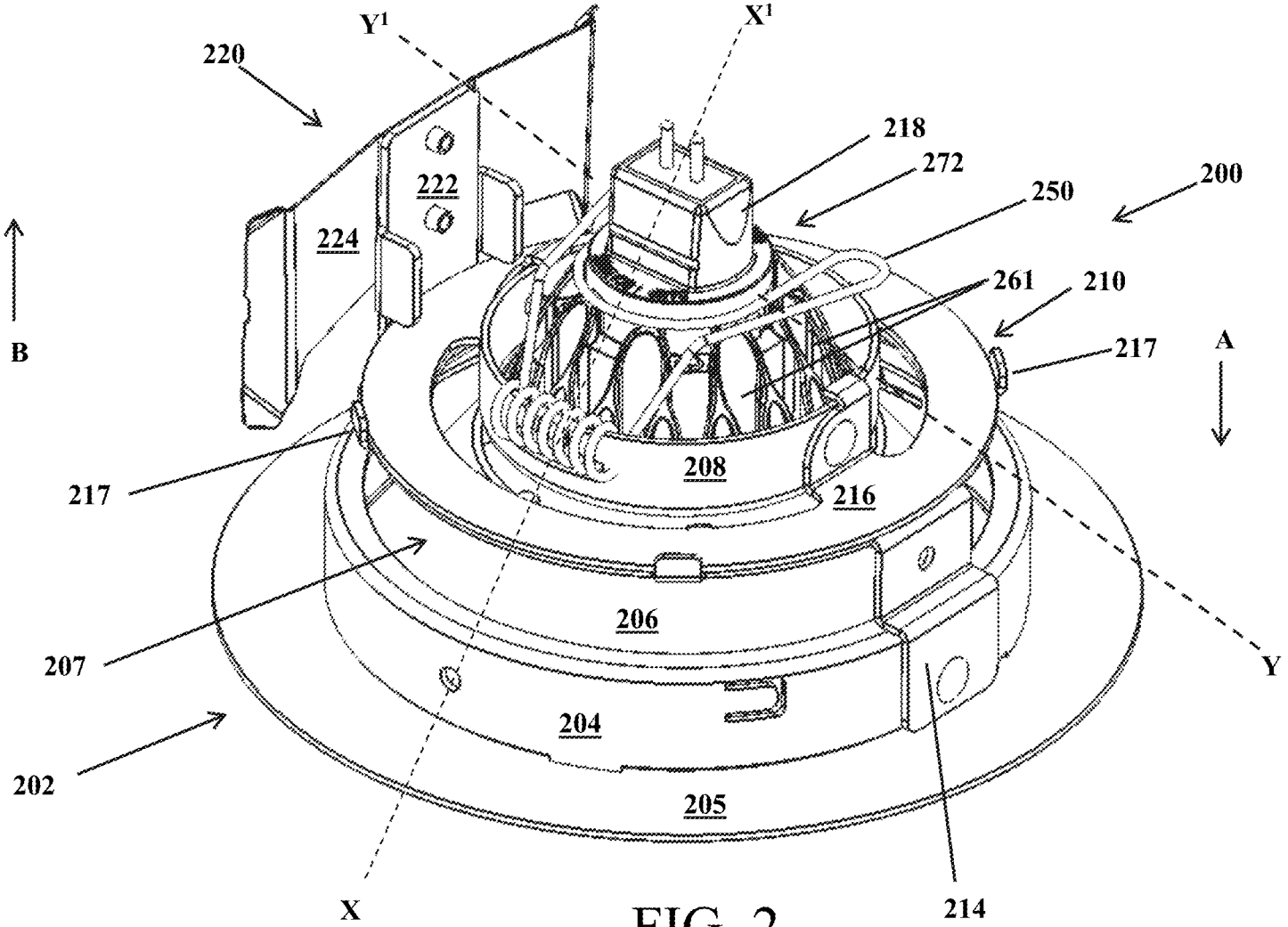
FIG. 2 illustrates a perspective view of an example recessed luminaire comprising a mousetrap spring retention device and a first example multifaceted reflector halogen lamp retained by the mousetrap spring retention device, in accordance with example embodiments of the present disclosure.

In the example embodiment illustrated in FIG. 2, the first light source lamp 218 may include a reflector type LED lamp, such as an MR16 LED floodlight lamp. However, in other example embodiments, the first light source lamp 218 may be replaced by any other appropriate lamp that may include, but is not limited to, an MR16 LED lamp with a GU10 base (shown in FIG. 7), the MR16 halogen lamp 108 (shown in FIGS. 1 and 10), a CFL lamp, etc., without departing from a broader scope of the present disclosure. Even though the figures of the present disclosure illustrate multifaceted reflector lamps, in other example embodiments, any other appropriate light source lamp may be used without departing from a broader scope of the present disclosure.

In addition to housing and/or supporting a first light source lamp 218 therein, the first light source holding bracket 208 may be configured to receive and pivotally couple a retention device 250 to the first light source holding bracket 208. The retention device 250 may be configured to securely retain and center the first light source lamp 218 within the first light source holding bracket 208 by applying an active load on the first light source lamp 218 as illustrated in FIG. 2 and as will be described in greater detail below.

Furthermore, the recessed luminaire 200 may include trim retention assembly 220 that is coupled to the trim assembly 202 via the rotation bracket assembly 210. The trim retention assembly 220 may be configured to dispose and retain the recessed luminaire 200 in a recessed housing can (not shown in Figures) that may be installed in a mounting surface such as a ceiling. In particular, the trim retention assembly 220 may include a trim retention bracket 222 that is coupled to the base bracket 214 of the rotation bracket assembly 210, and a trim retention device 224 that is coupled to the trim retention bracket 222. In one example embodiment, the trim retention device 224 may be a friction blade, however, in other example embodiments, the trim retention device 224 may include any other appropriate devices such as torsion springs, etc., without departing from a broader scope of the present disclosure.

Figure 3:
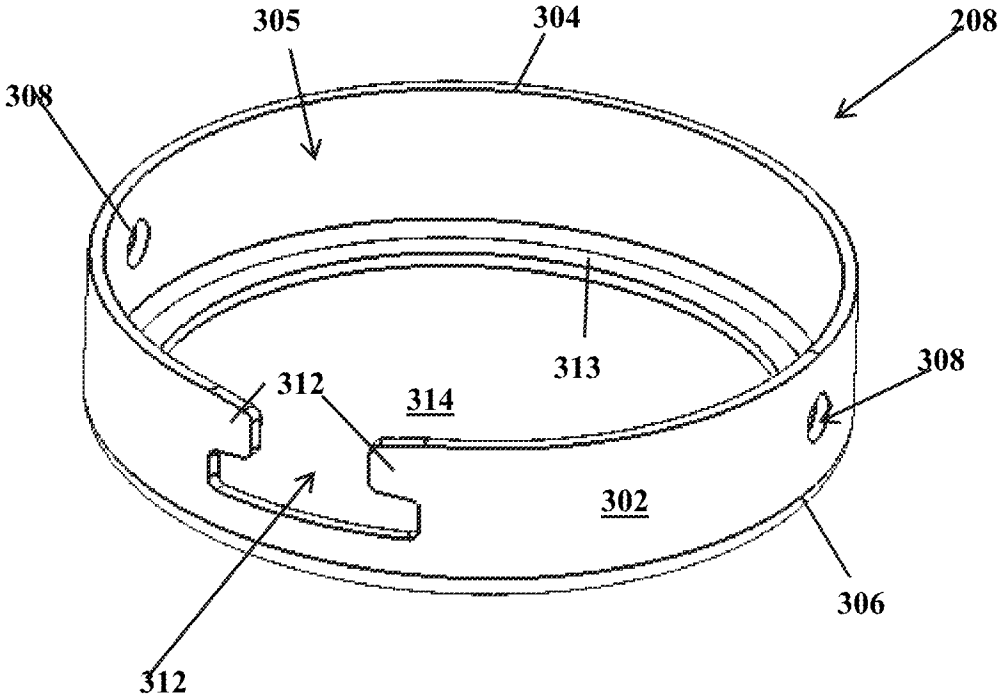
FIG. 3 illustrates a perspective view of a first example light source holding bracket of the recessed luminaire of FIG. 2, in accordance with example embodiments of the present disclosure.
Figure 5:
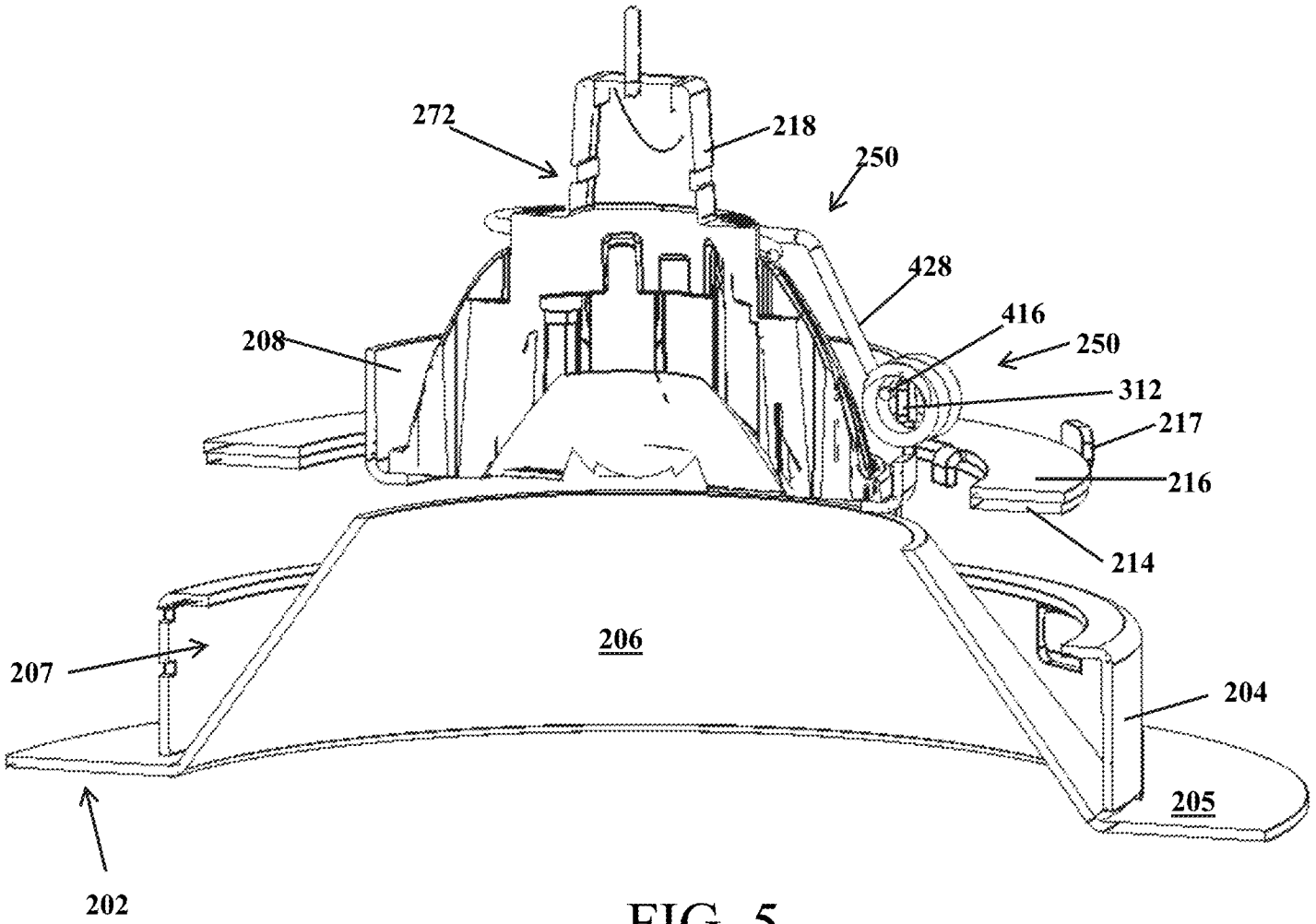
FIG. 5 illustrates a cross-section view of the recessed luminaire of FIG. 2 along an X-X' axis, in accordance with example embodiments of the present disclosure.
Figure 6:
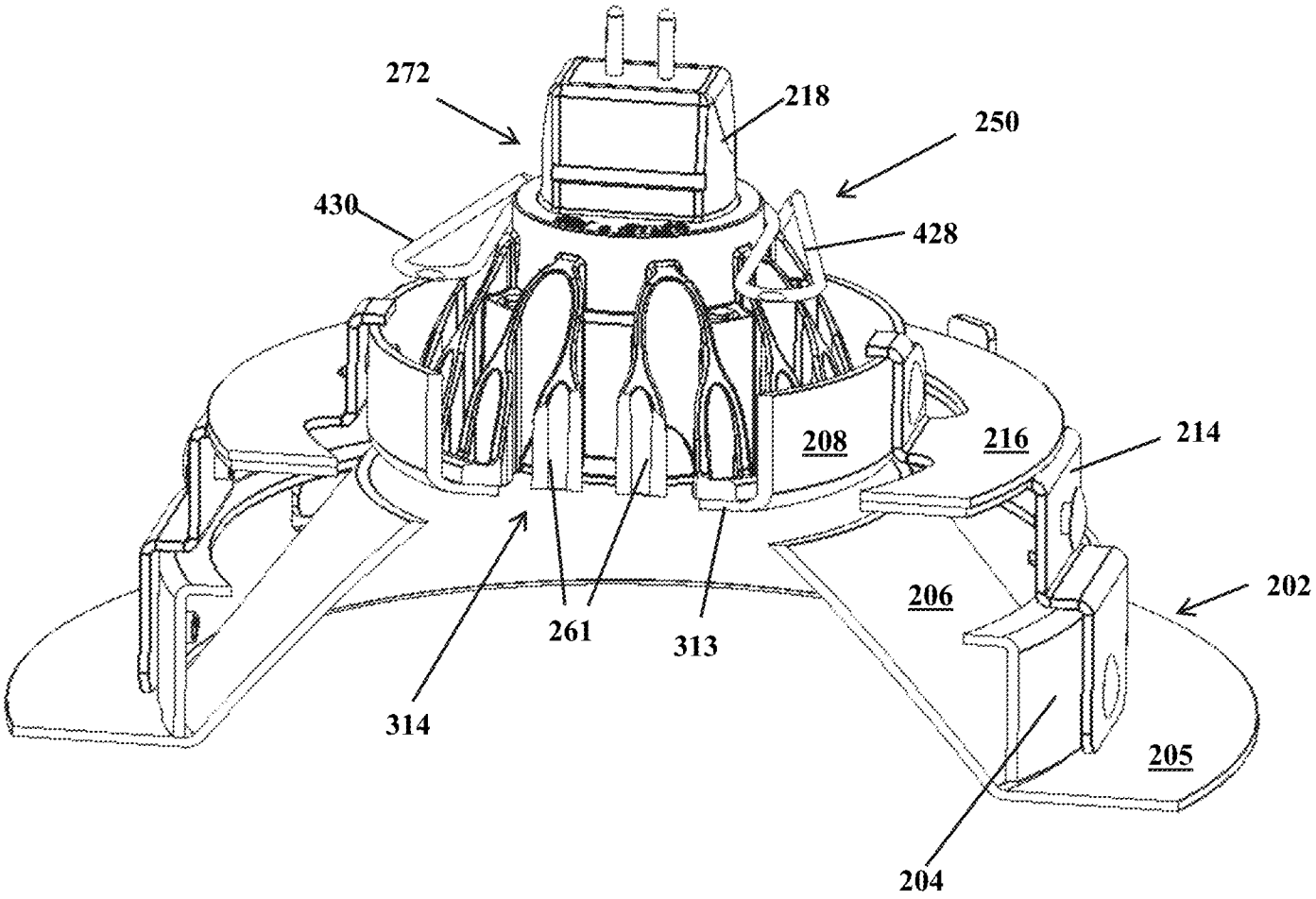
FIG. 6 illustrates a cross-section view of the recessed luminaire of FIG. 2 along a Y-Y' axis, in accordance with example embodiments of the present disclosure.

As illustrated in FIG. 3, that first light source holding bracket 208 may include a body 302 that is substantially cylindrical in shape and extending from a top edge 304 to a bottom edge 306. The body 302 may define an inner cavity 305. In particular, the body 302 may include one or more coupling apertures 308 and a coupling notch 310 formed therein. The coupling apertures 308 may be configured to receive fasteners there through to couple the first light source holding bracket 208 to the trim assembly 202 via a rotation bracket assembly 210 as illustrated in FIG. 2. The coupling notch 310 may be configured to pivotally couple the retention device 250 to the light source holder bracket 218 as illustrated in FIG. 2. The coupling notch 310 may extend from the top edge 304 towards the bottom edge 306 of the body 302 such that it is open on one end (e.g., at the top edge 304). Further, the coupling notch 310 may be substantially inverted T-shaped and may define two pivot arms 312 that face each other and are configured to receive and support a retention spring portion 404 (shown in FIG. 4) of the retention device 250 such that the retention device 250 is pivotally coupled to the light source holding bracket 208. In addition to the body 302, the first light source holding bracket 208 may include an inner flange 313 that extends inwards and into the inner cavity 305 from the bottom edge 306 of the body 302. The inner flange 313 of the first light source holding bracket 208 may define a shoulder on which the first light source lamp 218 rests as illustrated in FIGS. 5 and 6. The first light source lamp 218 may be housed in the light source holder bracket 208 such that light emitted by the first light source lamp 218 may exit the first light source holding bracket 208 via the light source emitting opening 314 defined by the inner flange 313 of the first light source holding bracket 208. Further, as illustrated in FIGS. 5 and 6, the first light source holding bracket 208 may be configured to hold the first light source lamp 218 above the reflector 206 of the trim assembly 202 such that light emitted by the first light source lamp 218 is directed towards an area to be illuminated through the reflector 206.

Figure 4A:
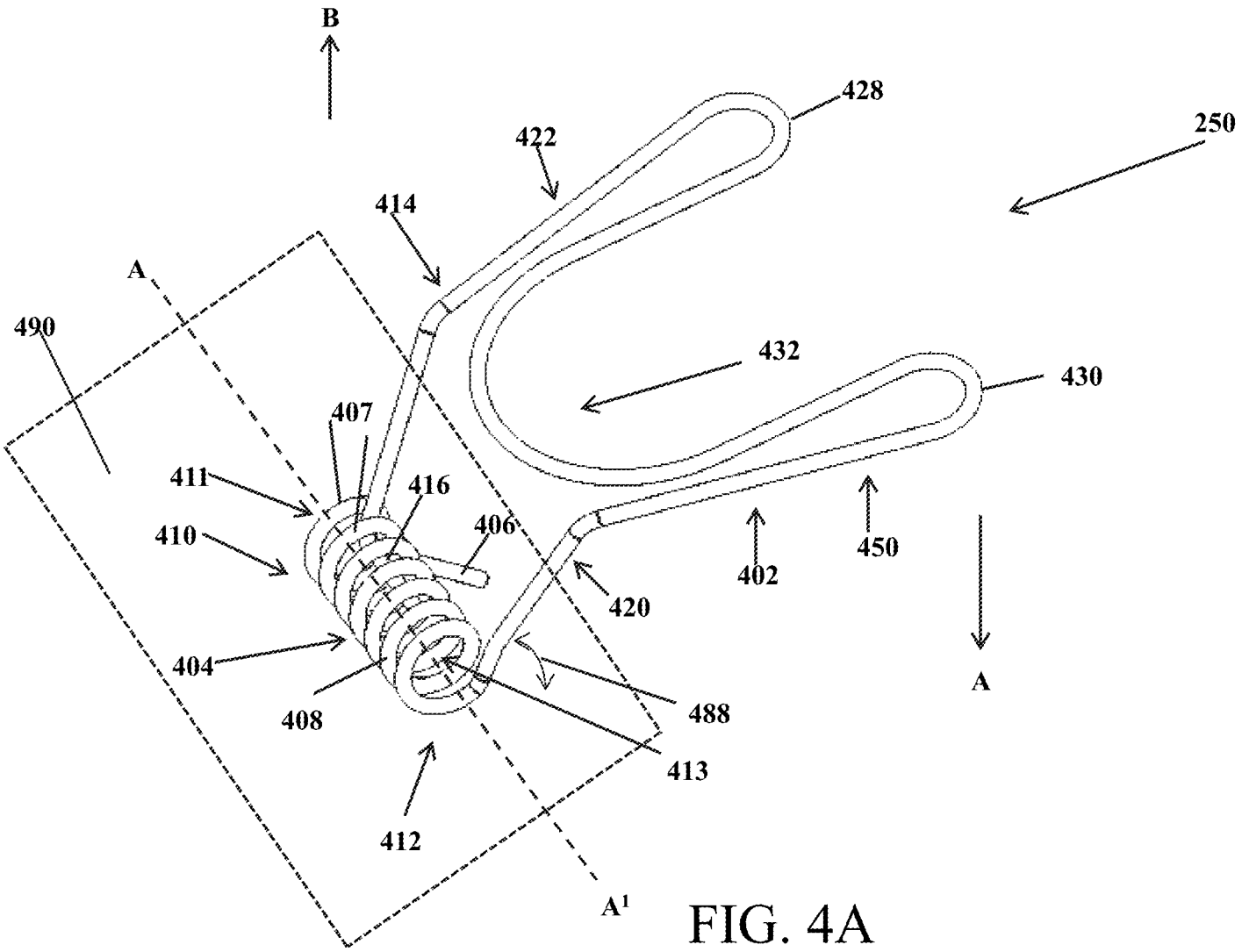
FIGS. 4A-4C (collectively 'FIG. 4') illustrate different views of the mousetrap spring based retention device of the recessed luminaire of FIG. 2, in accordance with example embodiments of the present disclosure.
Figure 4B:
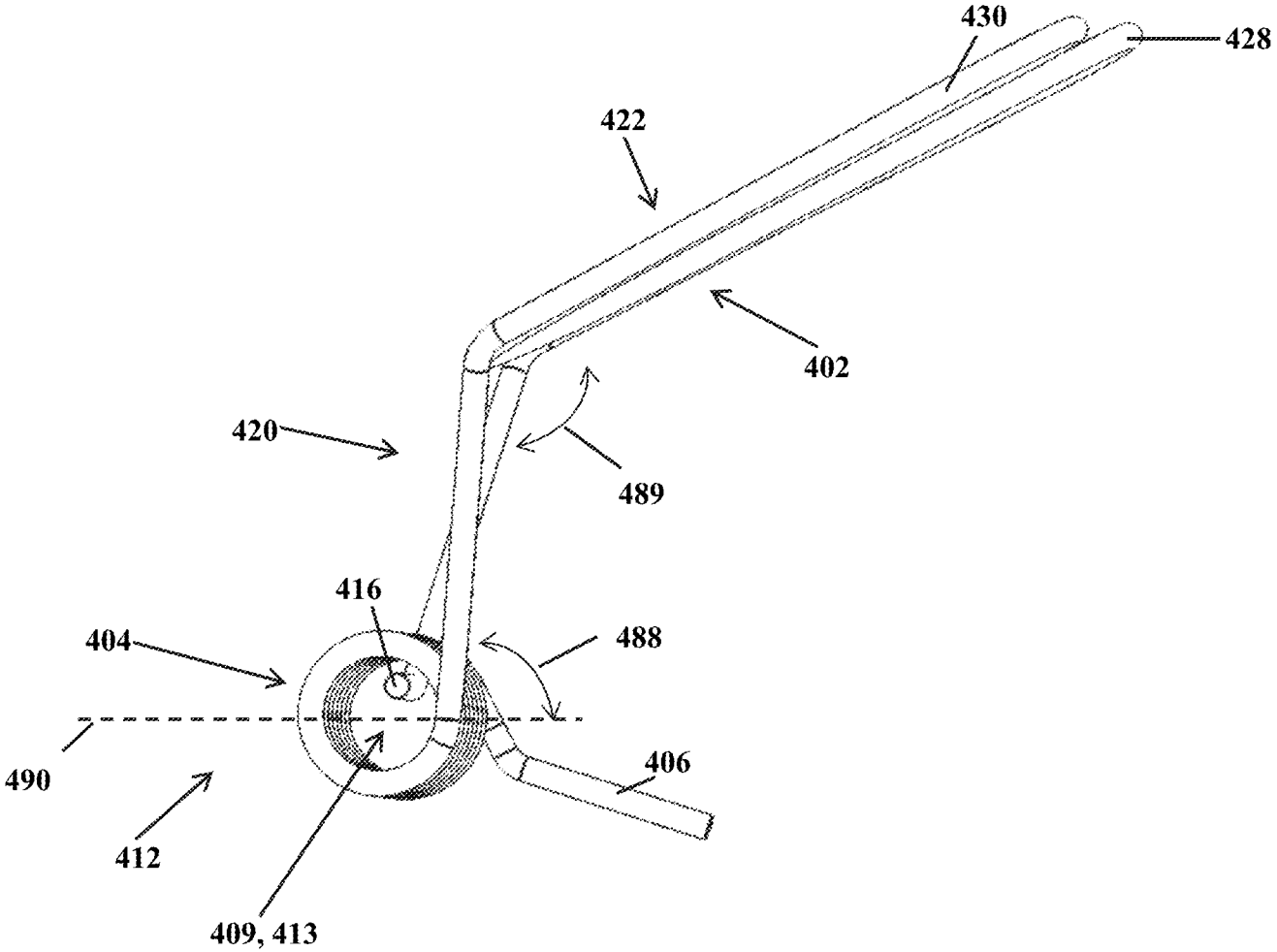
Figure 4C:
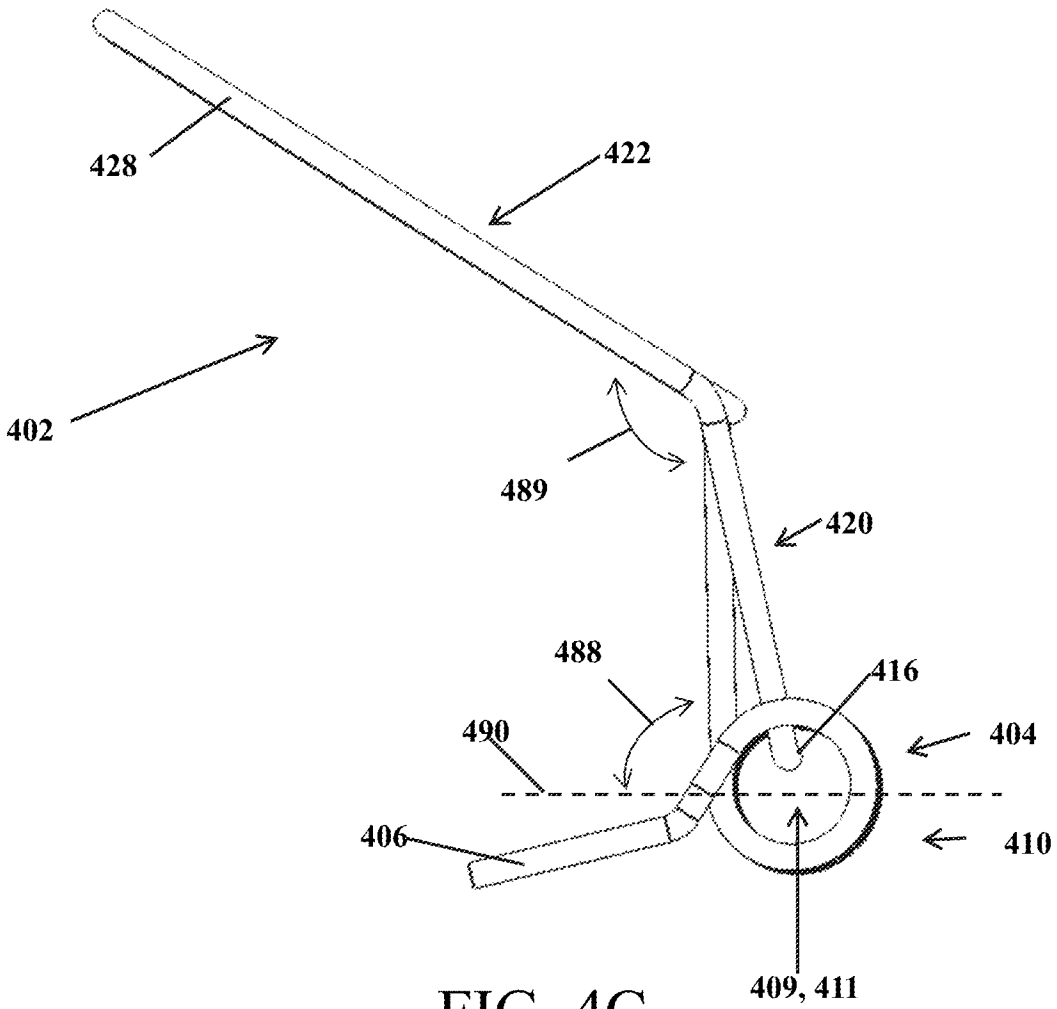

Turning to FIG. 4, the retention device 250 may be a mousetrap style retention spring device that comprises a retention arm portion 402 that is formed integral with a retention spring portion 404. The retention spring portion 402 may be configured to force the retention arm portion 404 in a first direction 'A', i.e., against a first light source lamp 218 that is disposed in the first light source holding bracket 208 for securely retaining the first light source lamp 218 within the first light source holding bracket 208.

In one example embodiment, the retention device 250 may be formed using a single piece of metal wire 450 or any other resilient wire. In particular, the metal wire 450 may be bent to form a first end arm 406. Then, the metal wire 450 may be helically wound or coiled into a compression spring 408 that extends from a first side 410 and a second side 412. The compression spring 408 may define a cavity 409 therethrough that extends from a first opening 411 on the first side 410 to a second opening 413 on the second side 412 of the compression spring 408. The first side 410 of the compression spring 408 may be closer to the first end arm 406 while the second side 412 of the compression spring 408 that is opposite to the first side 410 may be farther away from the first end arm 406. Further, the metal wire 450 may be extended from the second side 412 of the compression spring 408 to form the loop 414 that defines the retention arm portion 402. The loop 414 that defines the retention arm portion 402 terminates at a second end arm 416 of the metal wire 450 that is opposite to the first end arm 406. The second end arm 416 may be passed through an opening between two adjacent compression spring loops 407 on the first side 410 of the compression spring 408 that is closest to the first end arm 406 and inserted into the cavity 409 defined by compression spring 406 such that the second end arm 416 extends towards the second side 412 of the compression spring 406.

The loop 414 that defines the retention arm portion 402 may include a base segment 420 and a front segment 422. The base segment 420 of the loop 414 may extend away from the compression spring 408 such that it forms a substantially perpendicular angle 488 (or slightly less than 90 degree angle) with a longitudinal axis A-A' passing through the cavity 409 defined by the compression spring 408 or a plane 490 comprising the axis A-A'. The front segment 422 of the loop 414 may further extend from the base segment 420 such that it forms an obtuse inner angle 489 with the base segment 420. The front segment 422 may extend further away from the compression spring 408.

Figure 10:
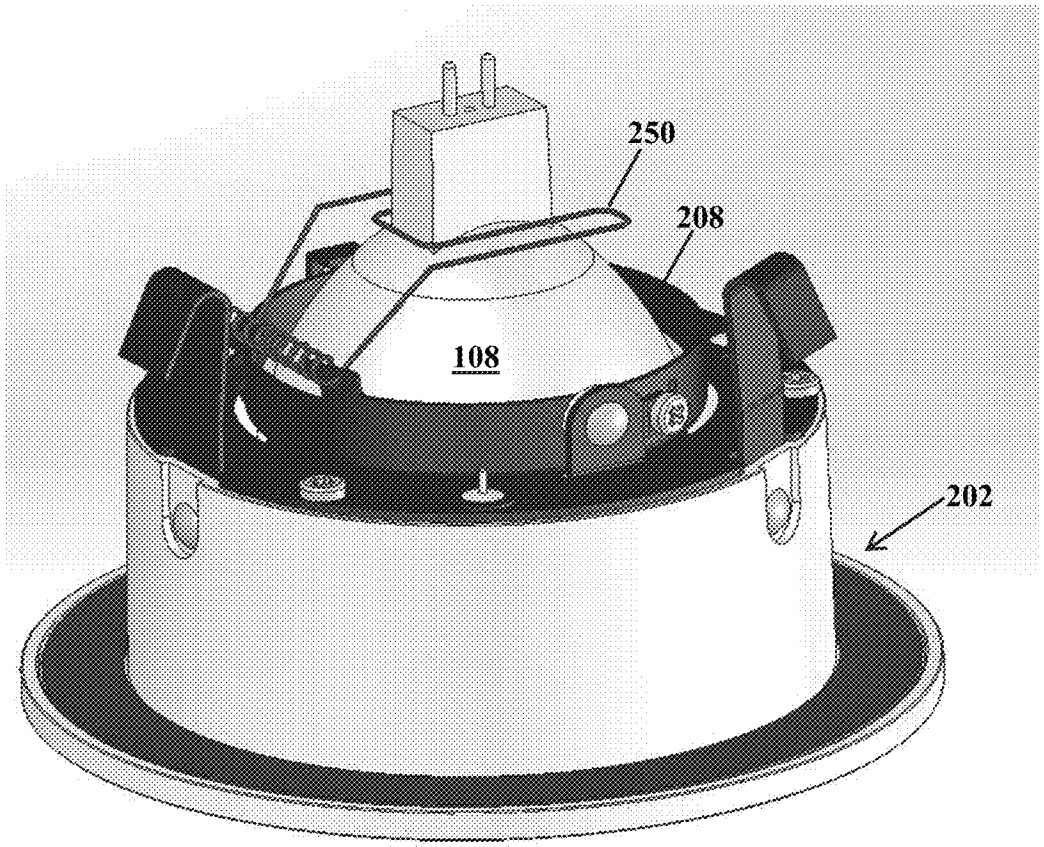
FIG. 10 illustrates a perspective view of yet another example recessed luminaire comprising the mousetrap spring retention device and the multifaceted reflector halogen lamp retained by the mousetrap spring retention device, in accordance with example embodiments of the present disclosure.

The front segment 422 of the loop 414 may define a first arm 428 and a second arm 430. Further, the front segment 420 of the loop 414 may include a notch or a retention opening 432 formed between the first and second arms (428, 430). The first and second arms (428, 430) of the retention device 250 may be designed as and/or configured to operate as flat springs. In one example embodiment, the retention opening 432 may be a substantially C-shaped opening, however, in other example embodiments, the retention opening 432 may have any other appropriate shape that is configured to: (a) receive and securely hold a portion of the first light source lamp 218 therein, and (b) apply sufficient active load on the first light source lamp 218 to securely retain the lamp within the first light source holding bracket 208 without departing from a broader scope of the present disclosure. For example, in some example embodiments, the retention opening 432 may be a substantially U-shaped opening as shown in FIG. 10.

As illustrated in FIGS. 1 and 5, the retention device 250 is securely hinged or pivotally coupled to the first light source holding bracket 208. In particular, the pivot arms 312 of the first light source holding bracket 208 may be inserted through the first and second openings (411, 413) on opposite sides (410, 412) of the compression spring 408. As illustrated in FIG. 5, The compression spring 408 may be coupled to the pivot arms 312 of the first light source holding bracket 208 such that the second end arm 416 of the retention device 250 engages the respective pivot arm 312 of the first light source holding bracket 208 to provide support and leverage to retention arm portion 402 of the retention device 250.

The compression spring 408 of the retention device 250 may be designed to provide sufficient strength to force the retention arm portion 402 of the retention device 250 in the first direction 'A', i.e., towards the first light source holding bracket 208, while preventing any damage to the first light source lamp 218 that is disposed in the first light source holding bracket 208. That is, the spring force provided by the compression spring 408 may be sufficient to: (a) push the retention arm portion 402 towards the first light source holding bracket 208 and apply an active load on the first light source lamp 218 disposed in the first light source holding bracket 208, while being gentle enough to prevent any damage to the first light source lamp 218.

In one example, to install the first light source lamp 218 in the recessed luminaire 200, the retention arm portion 402 of the retention device 250 may be pulled backwards in a second direction 'B' from its default position where the retention arm portion 402 may engage the first light source holding bracket 208 or may be disposed in the inner cavity 305 defined by the first light source holding bracket 208 (provided that there is no lamp disposed in the first light source holding bracket 208). The retention arm portion 402 may be pulled backwards till sufficient clearance is available for inserting the first light source lamp 218 in the first light source holding bracket 208 without engaging the arms (428, 430) of the retention arm assembly 402. The ability to pull the retention arm portion 402 of the retention device 250 back till sufficient clearance is available for inserting the first light source lamp 218 in the first light source holding bracket 208 allows for easy installation of the first light source lamp 218 in that the arms (428, 430) of the retention device 250 do not get caught in the heat sink fins 261 of the first light source lamp 218 unlike the retaining arms 171 of the existing retention device 102.

Responsive to placing the first light source lamp 218 in the first light source holding bracket 208, the retention arm portion 402 may be released to spring back to its default position. The retention arm assembly 402 that reverts back to its default positon may engage the first light source lamp 218 such that: (a) a portion 272 of the first light source lamp 218 is disposed in the retention opening 432 defined by the retention arm portion 402 of the retention device 250, (b) the arms (428, 430) of the retention device 250 engage the first light source lamp 218 and center the first light source lamp 218 within the first light source holding bracket 208, and (c) an active load is applied on the first light source lamp 218 by the arms (428, 430) of the retention device 250 to securely retain the first light source lamp 218 in the light source holding bracket without any undesirable movement.

In some example embodiments, the retention device 250 may be designed with a detent mechanism or a catch mechanism that holds the retention arm portion 402 of the retention device 250 in an open position when it is pulled backwards in the second direction B. Further, once the first light source lamp 218 is positioned in the first light source holding bracket 208, force may be applied to release the retention arm portion 402 from the open position to a closed position as illustrated in FIGS. 2, 5, and 6.

Even though FIGS. 2-6 of the present disclosure describe the retention device 250 as being configured to securely retain the first light source lamp 218, such as the MR16 LED floodlight lamp, in the first light source holding bracket 208 of the recessed luminaire, one of skill in the art can understand and appreciate that in other example embodiments, the retention device 250 is configured to securely retain different light source lamps of different shapes and sizes without departing from a broader scope of the present disclosure. In particular, the combination of the compression spring type retention spring portion 404 and the flat spring style retention arm portion 402 allows the mousetrap spring style retention device 250 to adapt to different body shapes and sizes of different light source lamps. The retention device 250 may be configured to apply an active (positive) load on the different body shapes and sizes of different light source lamps. For example, as illustrated in FIGS. 7-9 and FIG. 10, the retention device 250 may be configured to securely retain a second light source lamp 718 or a multifaceted reflector halogen lamp 108 by applying a positive load thereon even though the second light source lamp 718 is smaller in size and narrower than the first light source lamp 218 and the multifaceted reflector halogen lamp 108 (e.g., MR16 halogen lamp) is larger in size and wider in shape than the first light source lamp 218. The second light source lamp 718 may include an MR16 LED lamp with a GU10 base or an MR16 LED lamp with a GU5.3 base.

Unlike the existing retention device system (e.g., existing retention device 102) where the end user has to use one retention device for one type of light source lamp and another retention device for another type of light source lamp, the retention system of the present disclosure (e.g., retention device 250) of the present disclosure is configured to be used with and securely retain different light source lamps of different shapes and sizes by applying an active load to the respective light source lamps.

Figure 7:
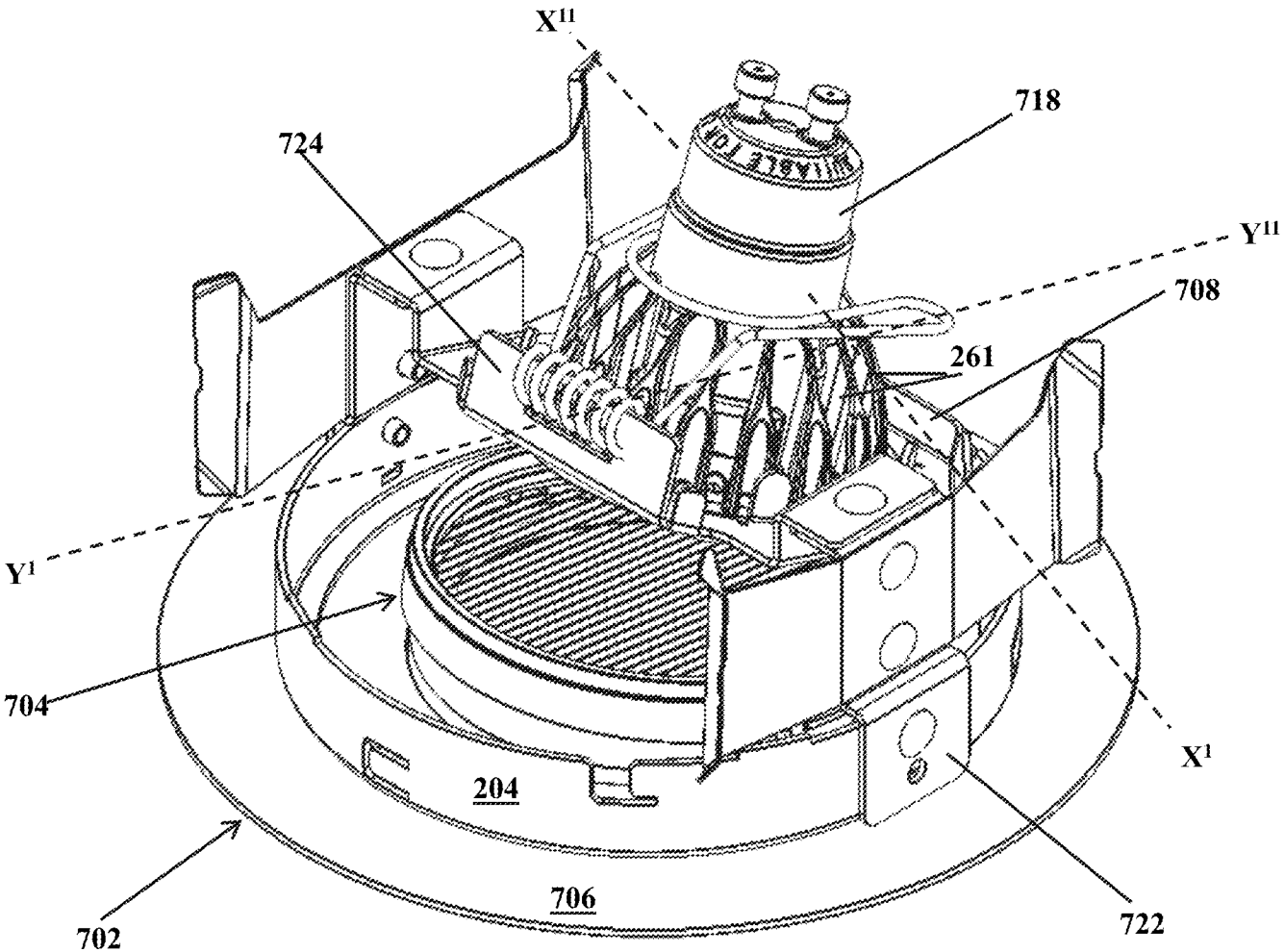
FIG. 7 illustrates a perspective view of another example recessed luminaire comprising the mousetrap spring retention device and a second example multifaceted reflector halogen lamp retained by the mousetrap spring retention device, in accordance with example embodiments of the present disclosure.
Figure 8:
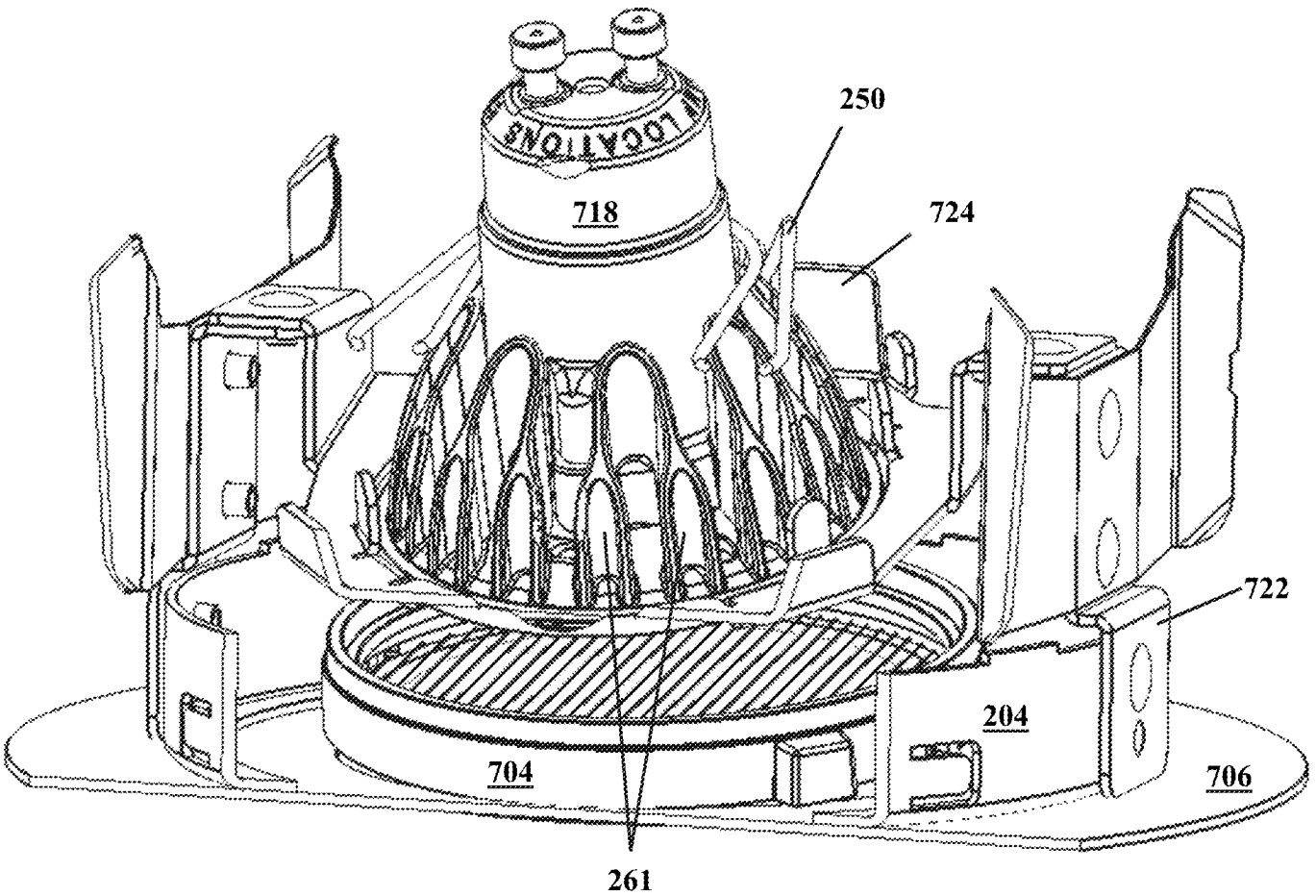
FIG. 8 illustrates a cross-section view of the recessed luminaire of FIG. 7 along an X'-X" axis, in accordance with example embodiments of the present disclosure.
Figure 9:
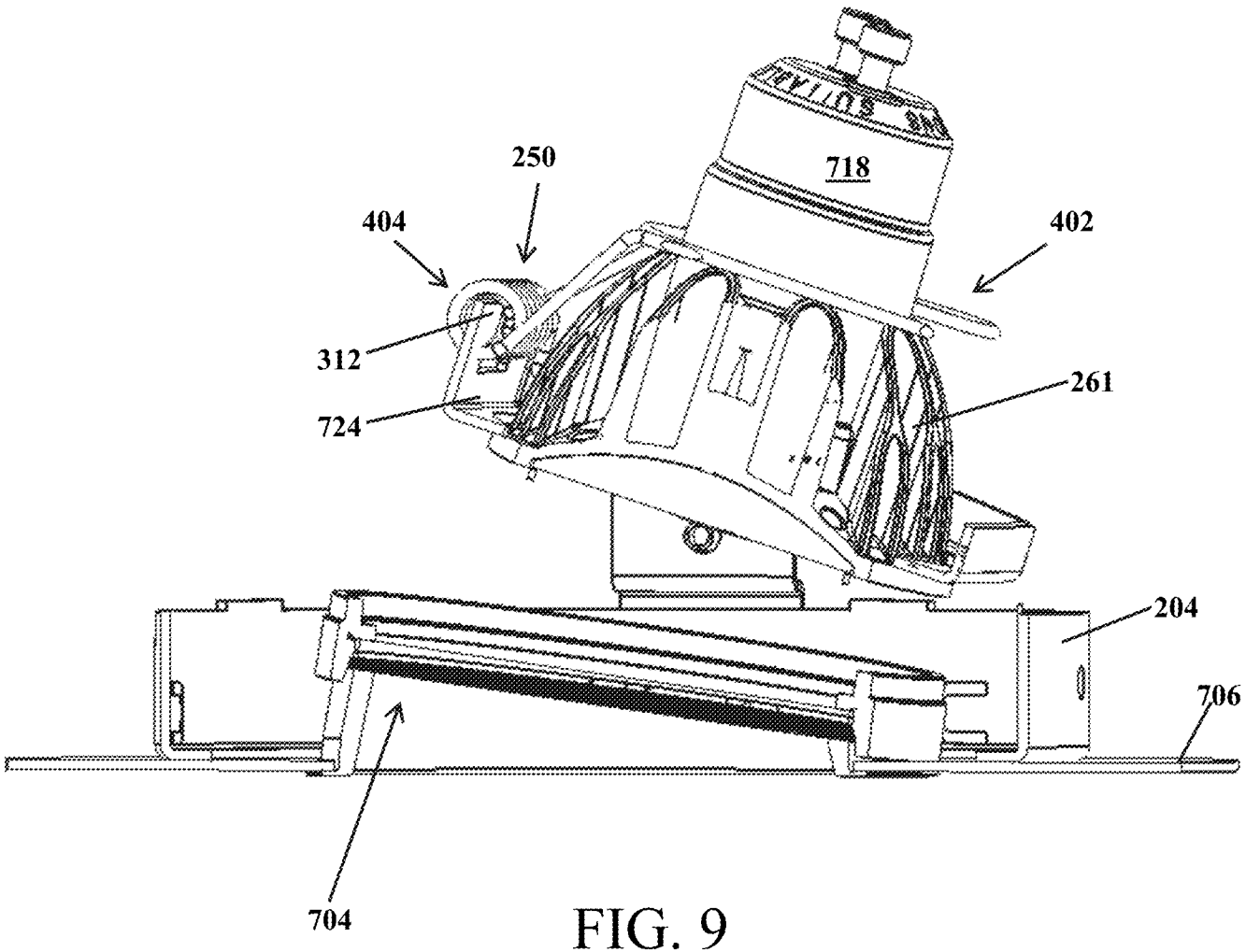
FIG. 9 illustrates a cross-section view of the recessed luminaire of FIG. 7 along a Y'-Y" axis, in accordance with example embodiments of the present disclosure.

Referring to FIGS. 7-9, the retention device 250 may be coupled to a second light source holding bracket 708 that may be configured to hold the second light source lamp 718 therein. The second light source holding bracket 718 may be coupled to the trim assembly 702 via a trim retention bracket 722. The trim assembly 702 may include the trim ring 204, a trim flange 706 with a light emitting aperture, and the lens assembly 704. The second light source holding bracket 708 may be configured to position the second light source lamp 718 above the trim assembly 702 as illustrated in FIGS. 7-9 such that light emitted by the second light source lamp 718 may exit the recessed luminaire 700 through the lens assembly 704. In particular, the second light source holding bracket 708 may include a retention device holding portion 724 that comprises the coupling notch 310 that defines two pivot arms 312 that are configured to pivotally couple the retention device 250 to the second light source holding bracket 708. The retention device 250 may be configured to securely retain the second light source lamp 718 within the second light source holding bracket 708 by applying an active load thereon. Similarly, referring to FIG. 10 the retention device 250 may be configured to securely retain the multifaceted reflector halogen lamp 108 within a light source holder bracket 104 by applying an active load thereon.

Although example embodiments are described herein, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A recessed luminaire comprising:

a light source holding bracket comprising a sidewall and a shoulder that defines a light emitting through opening and extends substantially perpendicular to the sidewall, the light source holding bracket configured to hold a light source lamp therein such that the light source lamp rests on the shoulder; and a retention device that is pivotally coupled to the light source holding bracket, the retention device comprising:

a retention spring portion that is pivotally coupled to the sidewall of the light source holding bracket; and a retention arm portion that extends from and is formed integrally with the retention spring portion, wherein the retention spring portion is configured to force the retention arm portion towards the light source holding bracket such that the retention arm portion engages and applies an active load on the light source lamp when disposed in the light source holding bracket to clamp the light source lamp between the retention arm portion and the shoulder of the light source holding bracket and thereby securely retain the light source lamp within the recessed luminaire.

2. The recessed luminaire of claim 1, wherein the sidewall of the light source holding bracket comprises a coupling notch that defines a pair of pivot arms that are configured to receive the retention spring portion of the retention device to pivotally couple the retention device to the light source holding bracket.

3. The recessed luminaire of claim 1, wherein the retention device is formed using a single piece of metal wire.

4. The recessed luminaire of claim 1, wherein the retention spring portion comprises a spring that extends from a first side that is adjacent a first end arm of the retention device to a second side that is opposite to the first side and away from the first end arm.

5. The recessed luminaire of claim 4, wherein the spring comprises a first opening on the first side and a second opening on the second side, and wherein the spring defines a cavity therethrough.

6. The recessed luminaire of claim 5, wherein the light source holding bracket comprises a first pivoting arm that is inserted into the first opening on the first side of the spring and a second pivoting arm that is inserted into the second opening on the second side of the spring to pivotally couple the retention device to the light source holding bracket.

7. The recessed luminaire of claim 3:

wherein the single piece of metal wire is helically wound to form a spring that defines the retention spring portion and that extends from one side of the spring to form a loop that defines the retention arm portion.

8. The recessed luminaire of claim 7:

wherein the loop comprises a first arm, a second arm, and a retention opening that is formed in between the first arm and the second arm, and wherein the retention arm portion is configured to engage the light source lamp such that a stem of the light source lamp extends through the retention opening that is formed between the first arm and the second arm.

9. The recessed luminaire of claim 7, wherein the loop terminates at a second end arm that is passed through an opening in between adjacent spring loops at the other side of the spring.

10. The recessed luminaire of claim 1, wherein the light source lamp is a multifaceted reflector halogen lamp.

11. The recessed luminaire of claim 1, wherein the light source lamp is a reflector type light emitting diode (LED) lamp that includes at least one of an MR16 LED floodlight lamp, an MR16 LED lamp with a GU10 base, and an MR16 LED lamp with a GU5.3 base.

12. The recessed luminaire of claim 1, wherein the retention device is adapted to securely retain different light source lamps having different body shapes and sizes, and wherein the different light source lamps include one of a multifaceted reflector halogen lamp and a reflector type LED lamp.

13. A retention system comprising:

a retention spring portion pivotally coupled to a light source holding bracket that comprises retention tabs, wherein the light source holding bracket is configured to house a multifaceted reflector lamp therein such that the multifaceted reflector lamp rests on the retention tabs; and a retention arm portion that extends from and is formed integrally with the retention spring portion, wherein the retention spring portion is configured to force the retention arm portion towards the light source holding bracket such that the retention arm portion engages and applies an active load on the multifaceted reflector lamp disposed in the light source holding bracket to clamp the multifaceted reflector lamp between the retention arm portion and the retention tabs of the light source holding bracket and thereby securely retain the multifaceted reflector lamp.

14. The retention system of claim 13, wherein the multifaceted reflector lamp comprises one of a reflector type light emitting diode (LED) lamp and a multifaceted reflector halogen lamp.

15. The retention system of claim 13, wherein the retention spring portion is formed using a single piece of metal wire that is helically wound to form a spring and that extends from one side of the spring to form a loop that defines the retention arm portion terminating adjacent another side of the spring that is opposite to the one side.

16. The retention system of claim 15, wherein the loop comprises a base segment and a front segment that further extends from the base segment such that it forms an obtuse inner angle with the base segment.

17. The retention system of claim 16, wherein the front segment of the loop defines a first arm, a second arm, and a retention opening that is formed in between the first arm and the second arm.

18. The retention system of claim 17, wherein the retention opening is configured to receive a stem of the multifaceted reflector lamp therein while the first arm and the second arm engage a top portion of the multifaceted reflector lamp such that the active load is applied to the multifaceted reflector lamp.

19. The retention system of claim 15, wherein the loop terminates at a second end arm that extends towards the one side of the spring and provides a support for the retention arm portion of the retention device.

20. The retention system of claim 13, wherein the retention system is adapted to securely retain different light source lamps having different body shapes and sizes, and wherein the different light source lamps include one of a multifaceted reflector halogen lamp and a reflector type LED lamp.

* * * * *